United States Patent [19]

Schmidt

[11] 4,102,463

[45] Jul. 25, 1978

[54] TRANSPORTER FOR SLAB CASTING TABLES

[76] Inventor: Hans Heinrich Schmidt, 1 Linton Ave., Lower Templestowe, Victoria, Australia

[21] Appl. No.: 750,429

[22] Filed: Dec. 14, 1976

[30] Foreign Application Priority Data

Dec. 17, 1975 [AU] Australia ..... PC4309

[51] Int. Cl.[2] ..... B66F 9/14

[52] U.S. Cl. ..... 214/671; 187/9 R; 214/730; 254/84; 254/87

[58] Field of Search ..... 214/730, 164 A, 512, 214/671, 670; 187/9 R, 9 E; 254/84, 87

[56] References Cited

U.S. PATENT DOCUMENTS

| | | | |
|---|---|---|---|
| 1,653,247 | 12/1927 | Zollinger | 254/87 |
| 2,595,707 | 5/1952 | Russell | 254/84 |
| 3,187,917 | 6/1965 | Miller | 214/730 |
| 3,640,503 | 2/1972 | Spannlang | 254/84 |
| 3,918,682 | 11/1975 | Despolmes | 254/87 |
| 3,934,741 | 1/1976 | Wentz | 214/730 |
| 4,007,847 | 2/1977 | Marco | 214/670 |
| 4,036,377 | 7/1977 | Weber | 214/512 |

FOREIGN PATENT DOCUMENTS

| | | | |
|---|---|---|---|
| 491,587 | 2/1976 | U.S.S.R. | 214/671 |

*Primary Examiner*—Lawrence J. Oresky
*Attorney, Agent, or Firm*—Murray & Whisenhunt

[57] ABSTRACT

A mobile transporter for use in transporting equipment during the construction of a building, said transport comprising a lower section supported on ground engaging means for movement thereon, a mast supported within the lower section for vertical movement relative to the lower section, with an upper frame supported on the upper end of the mast. The lower end of the mast carries a ground engaging support structure, and hydraulic lifting means are interconnected between the mast and support structure arrangement and the lower section for lowering and raising the mast and support structure between a position wherein the lower section is supported on the ground engaging means and a position whereby the support structure is moved to a ground engaging position for subsequently lifting the lower section and its ground engaging means off the ground whereby the lower section is supported on the support structure. Drives are provided to rotate the most relative to the lower section and to shift a horizontally movable carriage at the top of the most horizontally and vertically.

15 Claims, 12 Drawing Figures

TRANSPORTER FOR SLAB CASTING TABLES

This invention relates to a load transporter, and particularly to a transporter for casting tables for suspended concrete slabs in the building construction industry, and to methods of forming concrete floor slabs using such a transporter. Although the present invention is particularly applicable to transporting slab casting tables it is not restricted to such an application and may be applied to transporting any form of loads within relatively confined spaces.

The transporter according to this invention is also applicable to collecting, transporting and repositioning slab casting tables.

A transporter unit for building construction is known which comprises a lower frame supported on ground engaging means for movement thereon, an upper frame supported on the lower frame and adapted to supportingly engage beneath the slab casting table to be transported thereon. The transporter unit is particularly utilised in the handling system for slab casting tables in which the transporter unit is adapted to engage beneath the slab casting table after the completion of the casting of a floor slab section, and provides support for the table whilst it is disengaged from the slab casting position and for subsequently lowering the table and shifting it to a second casting position or to a position for subsequent collection and transport to a second casting position.

However, with such known transporter units movement of the transporter unit is effectively restricted to direct forward and reverse movements at a building site in view of the limited amount of room usually available for manoeuvering due to the presence of scaffolding, various temporary and permanent support structures including structural steel frame works, support columns, service cores and the like. The problem is considerably aggravated by the fact that a large number of slab casting tables encountered are of relatively large dimensions, rendering it inconvenient, if not impractical, in the majority of cases to cause table movements other than in the longitudinal or transverse directions of the casting tables. In any event, supporting a slab casting table on a transporter unit having only steerable wheels is inconvenient in view of the lack of space for manoeuvering, particularly with the slab casting tables supported thereon.

It is therefore one object of the present invention to provide a transporter which will enable movements with, or without, a slab casting table supported thereon, within a minimum amount of manoeuvering space, and more particularly a transporter having a facility whereby its direction of movement can be changed without the necessity for manoeuvering via steerable supporting wheels.

According to one aspect the invention envisages a mobile transporter for use in transporting equipment during the construction of a building, said transporter comprising a lower section supported on ground engaging means for movement thereon, a mast supported within said lower section for vertical movement relative to the lower section, and an upper frame supported on the upper end of said mast and adapted, in use, to supportingly engage beneath a load to be transported thereon, wherein the lower end of said mast carries a ground engaging support structure, lifting means interconnected between the mast and the support structure arrangement and said lower section for, in use, lowering and raising said mast and support structure between a position wherein said lower section is supported on said ground engaging means and a position whereby the support structure is moved to a ground engaging position for subsequently lifting said lower section and its ground engaging means off the ground whereby said lower section is supported on said support structure, and means cooperating with said mast and support structure arrangement and said lower section for achieving relative rotating movement between said lower section and said mast, wherein said mast incorporates means to raise said upper frame from a lower position spaced from the ground to a vertically higher position up to in the order of at least twice the distance that the upper frame is above the ground in the lower position.

With such a transporter it can, with, or without, a load supported thereon, traverse back and forth on the ground engaging means for the lower section, but when required to change its direction, for example, to move along a path at right angles to an existing path, the transporter is supported on the support structure with the lower section and ground engaging means lifted off the ground, whereby it may be swung about the mast structure to face in the direction in which movement is required, and lowered back onto the ground engaging means to achieve movement in the desired direction.

The means for achieving relative rotational movement between said mast structure and said lower section also allow said mast structure and the upper frame with, or without, a load supported thereon, to be swung within the lower section whilst the lower section on its ground engaging means is resting on the ground, and the mast and support structure arrangement is in its raised position.

The mast of the transporter is capable of extension in height as to enable loads to be raised over large heights, such as corresponding to more than one floor-to-floor height in multi-storey buildings.

According to this first aspect of the invention there is also envisaged in a method of forming concrete floor slabs during the construction of a building utilising a mobile transporter of the type having a lower section supported on ground engaging means for movement thereon, a mast supported within said lower section and having an upper frame supported on the upper end thereof and a ground engaging support structure on the lower end thereof, and means to raise the mast within the lower section to a position where the lower section and its ground engaging means are lifted off the ground and supported on said ground engaging support structure, means to achieve relative rotating movement between the lower section and the mast, whilst said mast incorporates means to raise the upper frame from a lower position spaced from the ground to a vertically higher position up to in the order of at least twice the distance the upper frame is above the ground in the lower position, said method including the steps of supporting a slab casting table beneath a first casting position, pouring concrete on the upper surface of said table to form at least a section of floor slab, allowing the concrete to solidify, positioning said transporter beneath said table and elevating said mast to engage the upper frame of said transporter beneath said table, disengaging the support for said table, lowering said table on said transporter from beneath said first casting position and transporting said table on said transporter to a position beneath a second casting position, raising said table on said transporter and supporting said table at said second casting position, and disengaging the upper frame of said transporter from beneath said table in said second casting position by lowering said mast.

According to this first aspect of the invention there is still further envisaged in a method of constructing successive vertically higher concrete floor slabs in a multi-storied building utilising a transporter of the type having a lower section supported on ground engaging means for movement thereon, a mast supported within said lower section and having an upper frame supported on the upper end thereof and in ground engaging support structure on the lower end thereof, means to raise the mast structure within the lower section between a position where the lower section and its ground engaging means are lifted off the ground and supported on said ground engaging support structure, means to achieve relative rotating movement between the lower section and the mast, with said mast incorporating means to raise the upper frame from a lower position spaced from the ground to a vertically higher position up to in the order of at least twice the distance that the upper frame is above the ground in the lower position, said method including the steps of supporting a slab casting table beneath a first casting position at a lower floor slab level, pouring concrete on the upper surface of said table to form at least a section of floor slab, allowing the concrete to solidify, positioning said transporter beneath said table and elevating said mast to engage the upper frame of said transporter beneath said table, disengaging the support for said table, lowering said table on said transporter from beneath said first casting position and transporting said table on said transporter to a position whereby it may be elevated to a position above the lower floor slab level for subsequent transportation and positioning at a second casting position beneath an upper floor slab level.

According to a second aspect of the invention there is envisaged a mobile transporter for use in transporting equipment during the construction of a building, said transporter comprising a lower section supported on ground engaging means for movement thereon, a mast supported within said lower section for vertical movement relative to said lower section, and an upper frame supported on the upper end of said mast, wherein the lower end of said mast carries a ground engaging support structure, lifting means interconnected between the mast and the support structure arrangement and said lower section for, in use, lowering and raising said mast and support structure between a position wherein said lower section is supported on said ground engaging means and a position whereby said support structure is moved to a ground engaging position for subsequently lifting said lower section and its ground engaging means off the ground whereby said lower section is supported on said support structure, means cooperating with said mast and support structure arrangement and said lower section for achieving relative rotating movement between said lower section and said mast, and wherein said upper frame carries a horizontally slidable carriage adapted, in use, to supportingly engage beneath a load to be transported thereon, and means are provided to move said carriage between extended and retracted positions relative to said upper frame.

With such a horizontally slidable carriage, a load supported on the transporter may be moved horizontally relative to the top of its mast to a position beyond the edge of a building, whilst the transporter is stationary adjacent to and within the edge of the building as to enable a load to be presented to a crane to lift the load up outside the building to another level.

According to this second aspect of the invention there is also envisaged in a method of constructing successive vertically higher concrete floor slabs in a multi-storied building utilising a transporter of a type having a lower section supported on ground engaging means for movement thereon, a mast supported within said lower section and having an upper frame supported on the upper end thereof and a ground engaging support structure on the lower end thereof, means to raise the mast structure within the lower section to a position where the lower section and its ground engaging means are lifted off the ground and supported on said ground engaging support structure, means to achieve relative rotating movement between the lower section and the mast, said mast incorporating means to raise the upper frame from a lower position spaced from the ground to a vertically higher position, whilst said upper frame carries a horizontally slidable carriage adapted, in use, to supportingly engage beneath a slab casting table to be transported thereon with means to move the carriage between extended and retracted positions, said method including the steps of supporting a slab casting table beneath a first casting position at a lower floor slab level, pouring concrete on the upper surface of said table to form at least a section of floor slab, allowing the concrete to solidify, positioning said transporter beneath said table and raising said mast to engage the carriage beneath said table, disengaging the support for said table, lowering said table on said transporter from beneath said first casting position and transporting said table on said transporter to a position adjacent the edge of said first level, extending said horizontally slidable carriage to move said table thereon to a position where the centre of gravity of the table lies outside the line of the edge of the building, collecting said table by an overhead crane and thereafter raising it to a position above said lower floor slab level for subsequent positioning at a second casting position beneath an upper floor slab level.

According to this second aspect of the invention there is still further envisaged in a method of constructing successive vertically higher concrete floor slabs in a multi-storied building utilising a transporter of the type having a lower section supported on ground engaging means for movement thereon, a mast supported within said lower section and having an upper frame supported on the upper end thereof and a ground engaging support structure on the lower end thereof, means to raise the mast structure within the lower section to a position where the lower section and its ground engaging means are lifted off the ground and supported on said ground engaging support structure, means to achieve relative rotating movement between the lower section and the mast, said mast incorporating means to raise the upper frame from a lower position spaced from the ground to a vertically higher position up to in the order of at least twice the distance the upper frame is above the ground in the lower position, whilst said upper frame carries a horizontally slidable carriage adapted, in use, to supportingly engage beneath a slab casting table to be transported thereon with means to move the carriage between extended retracted positions, said method including the steps of supporting a slab casting table beneath a first casting position at a lower floor slab leve, pouring concrete on the upper surface of said table to form at least a section of floor slab, allowing the concret to solidify, positioning said transporter beneath said table and raising said mast to engage the carriage of said transporter beneath said table, disengaging the support for said table, lowering said table on said transporter from beneath said first casting position and transporting said table on said transporter to an access opening through said first level, extending said carriage to position said table for subsequent transportation and positioning at a second casting position beneath an upper floor slab level.

Two preferred forms of the transporter incorporating the present invention, and several forms of building construction techniques utilising such transporters will now be described with reference to the accompanying drawings in which.

Figure 3:
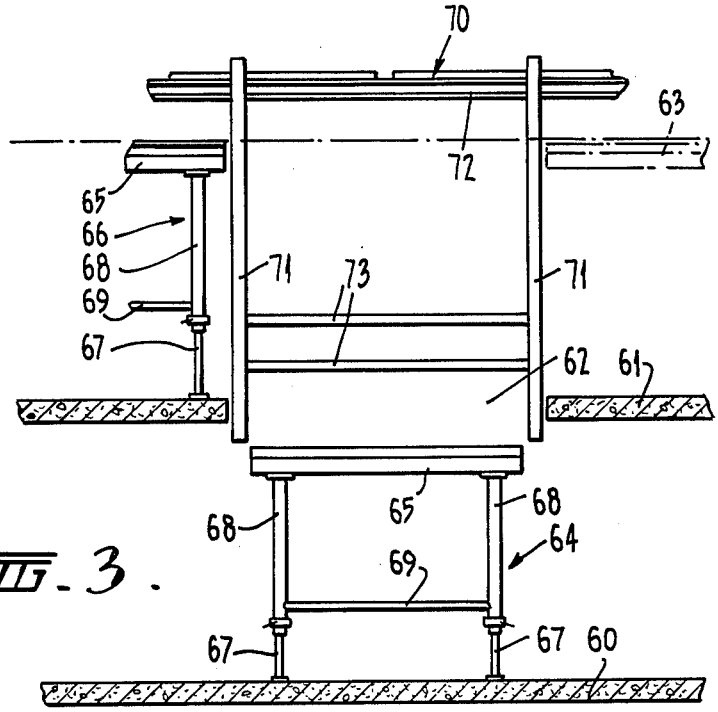
Figure 12:
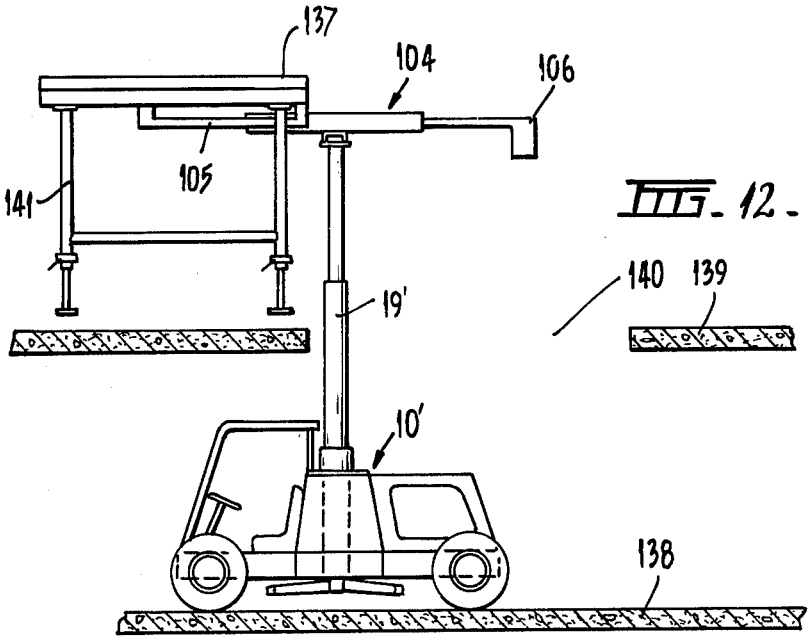
Figure 4:
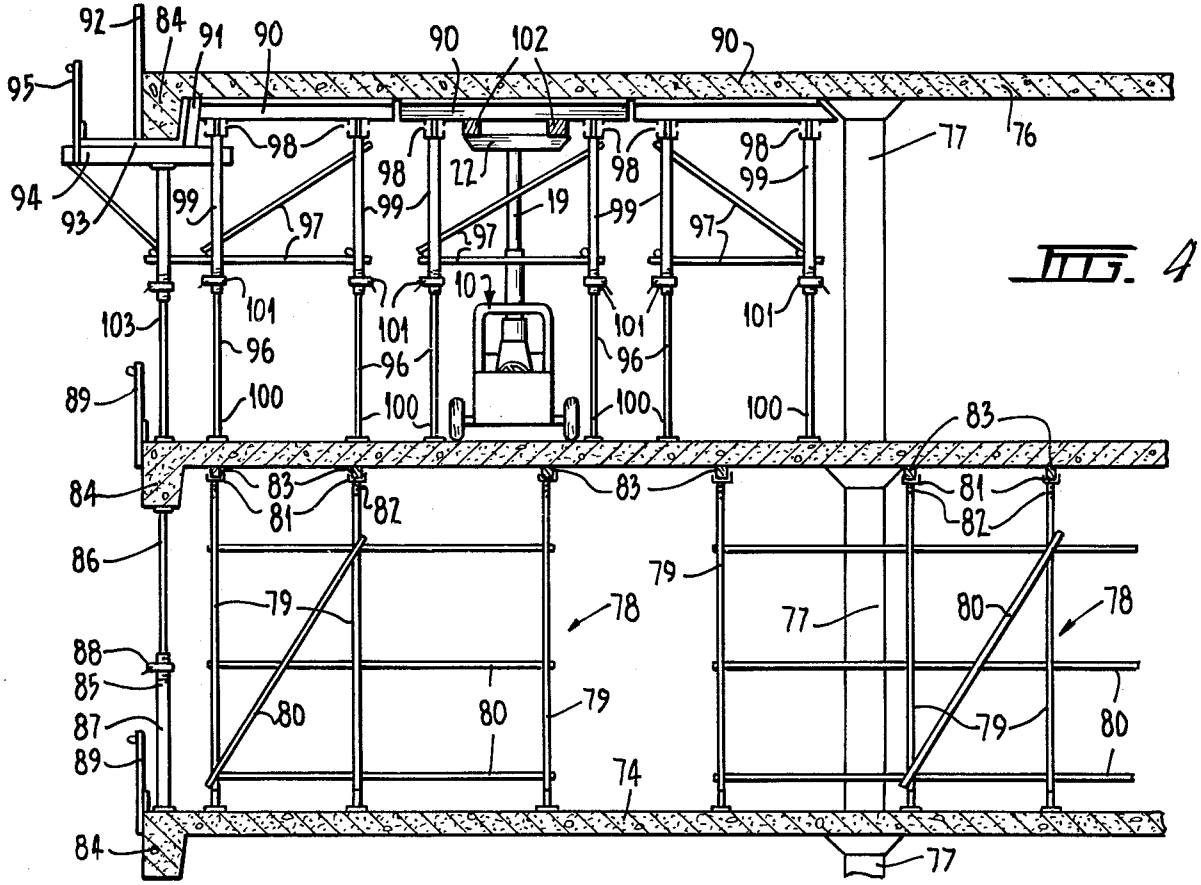
Figures 5, 6, 7, 8, 9:
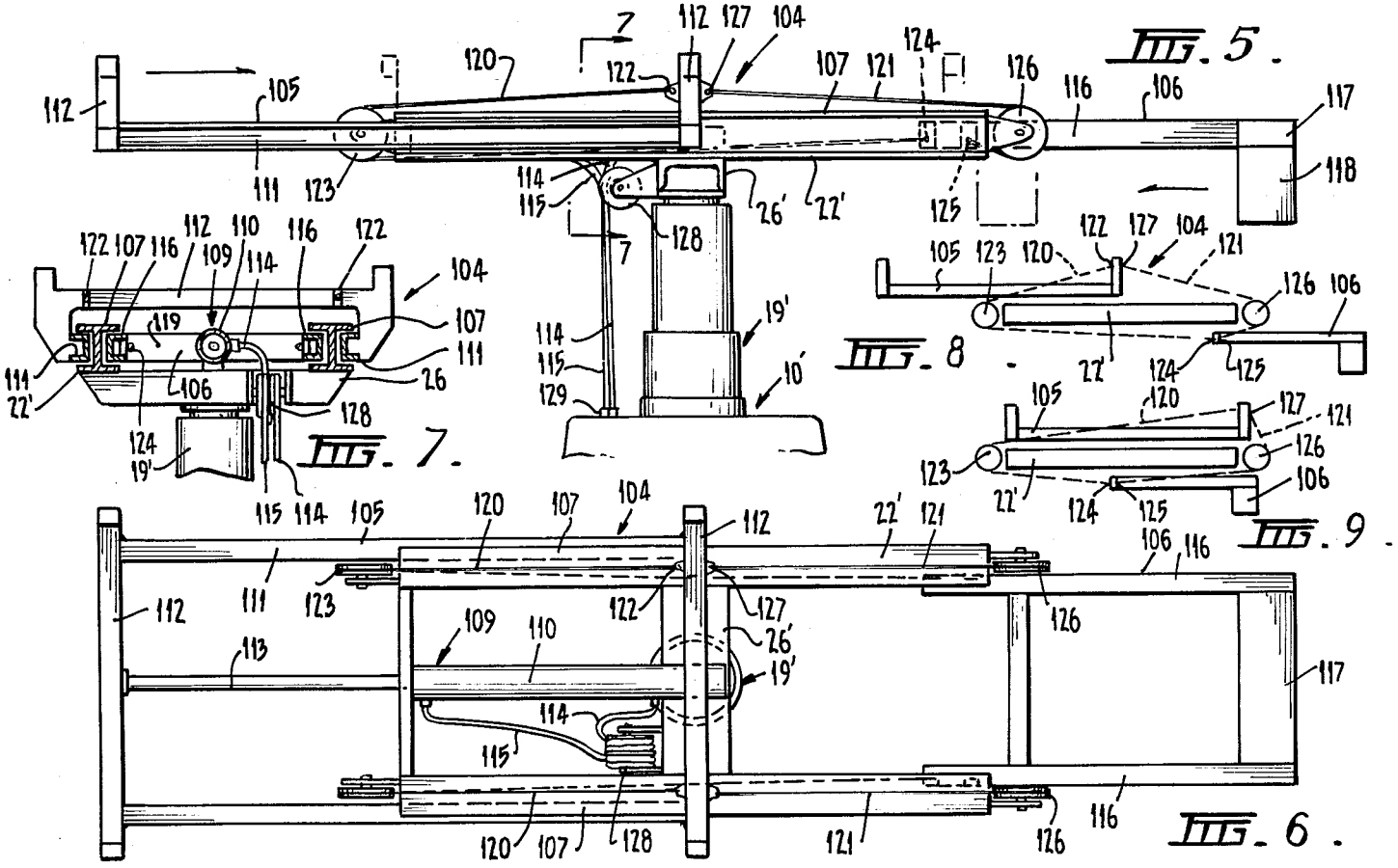
Figure 10:
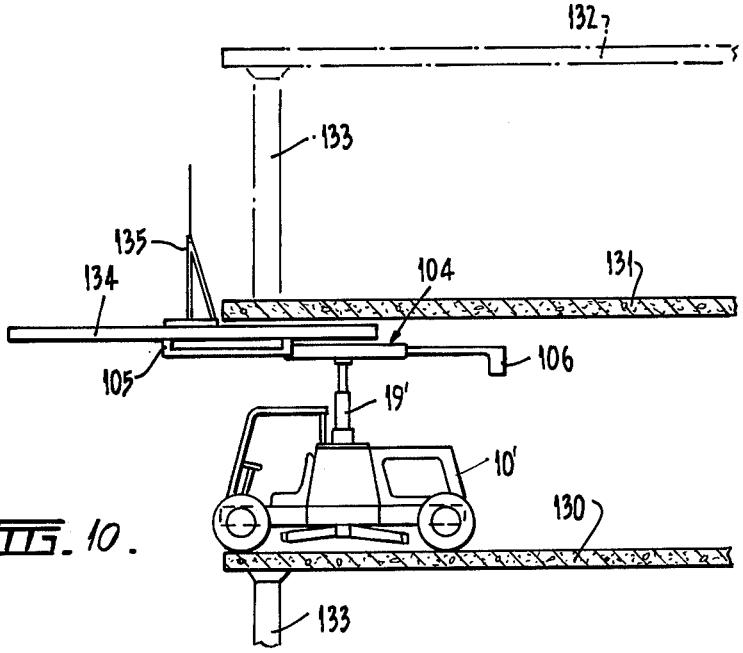
Figure 11:
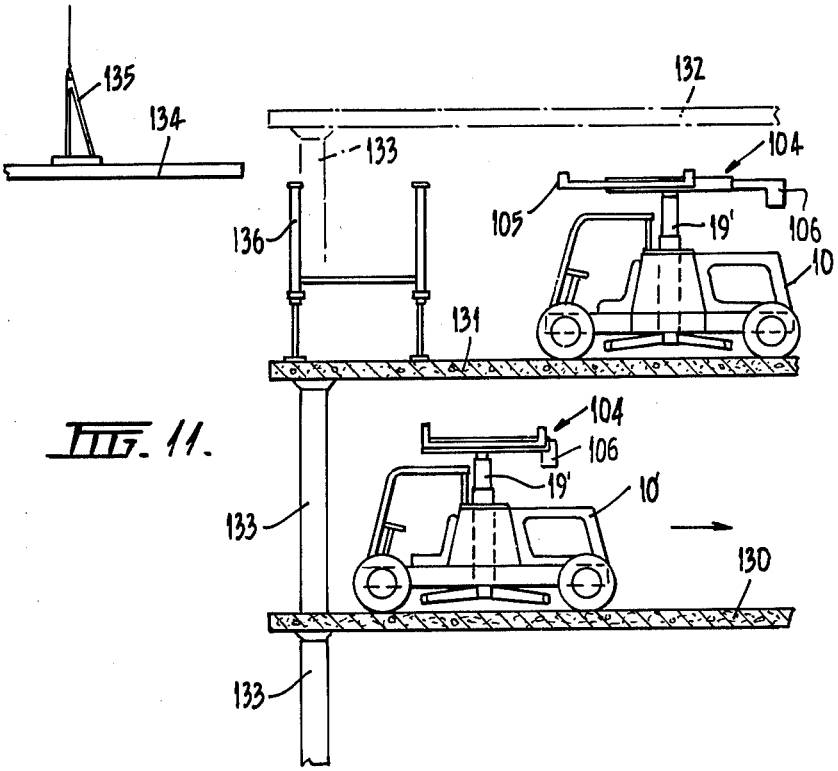

FIG. 3 is a side elevational view through three levels in a building structure showing an arrangement of a lifting frame incorporating a monorail hoist mounted over an access opening in the intermediate floor level, and temporary support structures, at the lower and intermediate levels for supporting the slab casting tables during two stages of elevating the tables via the access opening, and with which the first preferred form of transporter of this invention may cooperate, FIG. 4 is a side elevational view through three levels in a building structure showing arrangement of integral casting table support frames, the heights of which are adjustable for supporting the slab casting tables in casting positions, and with which tables the first preferred form of the transporter of this invention may cooperate, FIG. 5 is a detailed side elevational view of the top section of a second preferred form of transporter incorporating a horizontally slidable carriage, FIG. 6 is a plan view of the top section of the transporter of FIG. 5, FIG. 7 is a cross-sectional view taken along line 7—7 of FIG. 5, FIGS. 8 and 9 are schematic representations of the slidable carriage of FIGS. 5 to 7 showing the manner of achieving horizontal translation of said carriage and therefore any slab casting tables supported thereon, FIGS. 10 and 11 are side elevational views through three levels in a building structure showing how the transporter of FIGS. 5 to 7 may be utilised to transport and transfer the slab casting table from one level to the next vertically higher level, and FIG. 12 is a side elevational view through two levels in a building structure showing an alternative technique whereby the transporter of FIGS. 5 to 7 may be utilised to transport and transfer a slab casting table from one level to the next vertical upper level.

Figure 1:
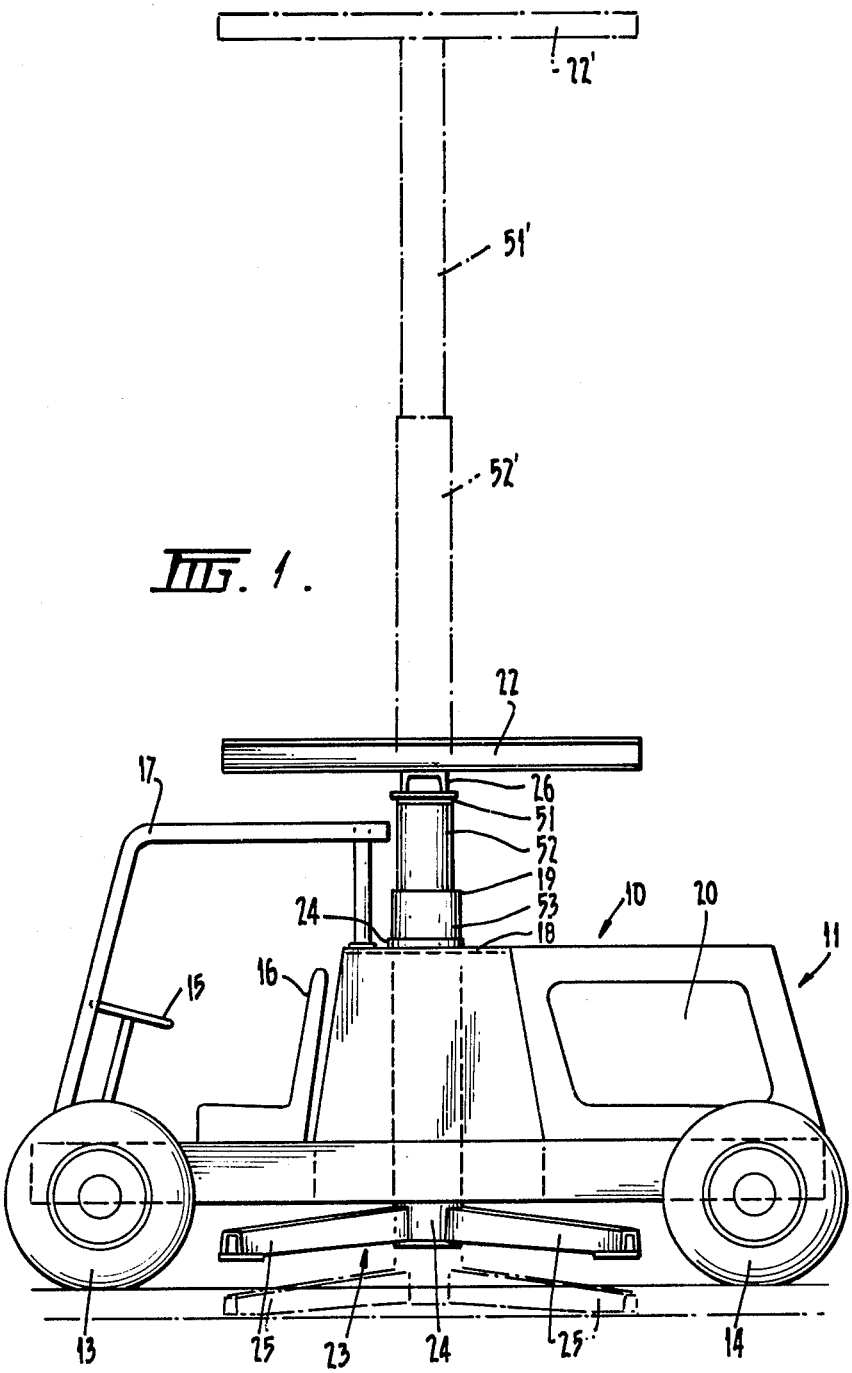
FIG. 1 is a side elevational view of a first preferred form of transporter.

Referring to FIG. 1 of the drawings there is shown a transporter generally indicated as 10, including a lower section 11 comprising a chassis 12 supported on front and rear pairs of ground engaging wheels 13 and 14 respectively. Although not essential, the front wheels 13 may be steerable to at least facilitate some limited steering movements if necessary via a steering wheel 15 situated adjacent an operator for which a seat 16 is provided. Controls (not shown) for the various hydraulic systems within the transporter are also provided adjacent the operator's seat 16. The operator is protected by a framework protective member 17. The lower section 11 also incorporates approximately in the centre thereof a lifting and rotating section generally indicated as 18 through which a vertically extending mast structure 19 passes, whilst adjacent the rear of the transporter a power section 20 is provided incorporating a petrol driven power unit driving a pump or pumps for hydraulic fluid from a main reservoir, together with a hydraulic motor for driving the rear wheels 14 through a differential, and for also driving a hydraulic motor 21 (see FIG. 2) within the lifting and rotating section 18 for achieving relative rotation between the lower section 11 and the mast structure 19 as will be later described.

An upper table support frame 22 is attached to the upper end of the mast structure 19 via a lateral support member 26 and is in the form of a square or rectangular shaped platform, whilst the lower end of the mast structure 19 carries a ground engaging support structure 23 comprising a central upwardly extending tubular member 24 of square cross-section forming part of the mast structure 19 with four radially outwardly extending feet members 25 forming a quadruped structure.

Figure 2:
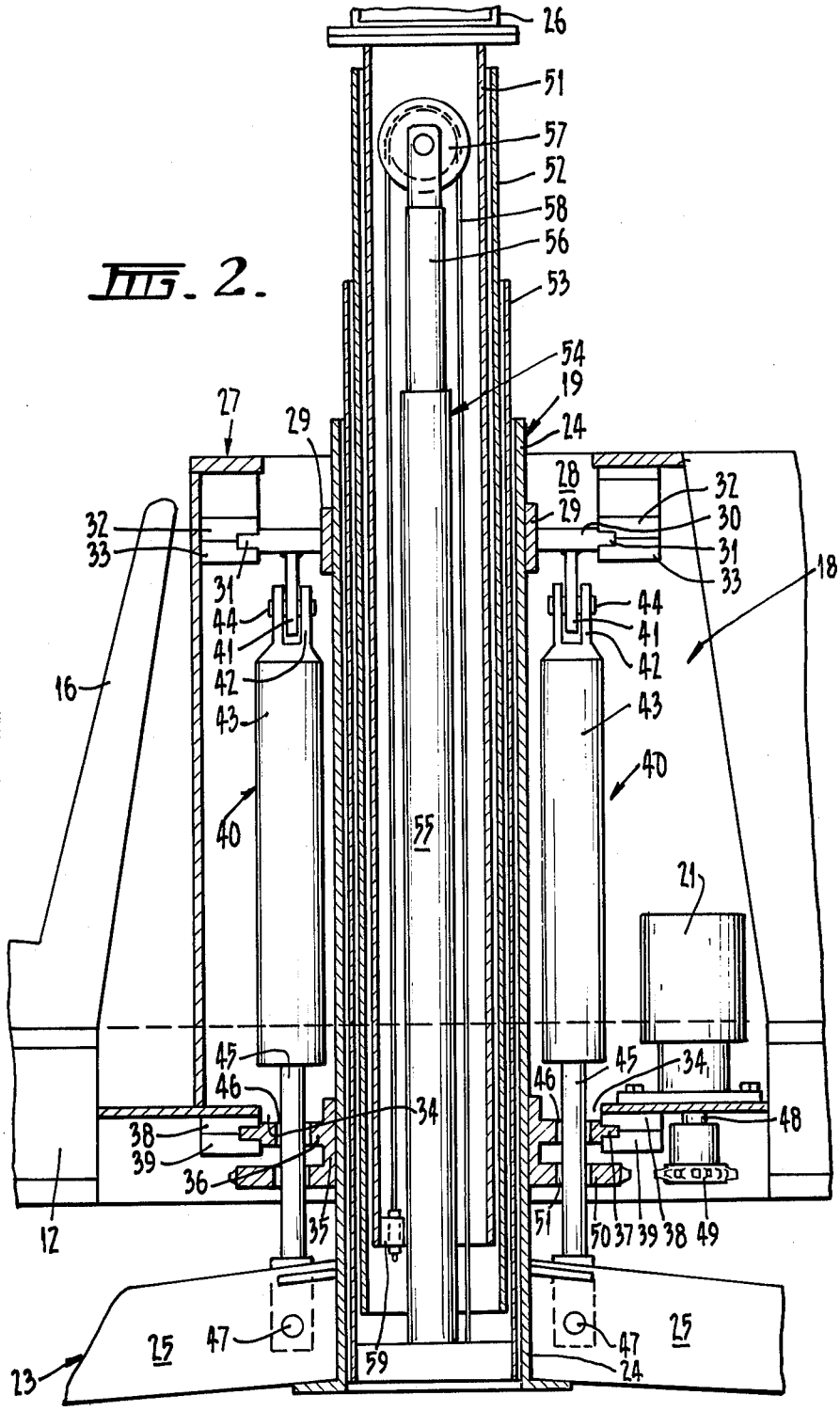
FIG. 2 is a detailed cross-sectional view of part of the transporter of FIG. 1.

Referring to FIG. 2 of the drawings in particular, the upwardly extending tubular member 24 extends through the lifting and rotating section 18 and is surrounded by a housing 27 outwardly through which the mast structure 19 extends through a top opening 28 and a bottom opening 34. The upper end of the tubular member 24 is surrounded by an upper guide member 29 having a mating square cross-section and for which the internal dimensions are slightly greater than the external dimensions of the tubular member 24 to confine the member 29 against lateral movement but allow axial movements thereof within the upper guide member 29. The upper guide member 29 is attached to an encircling plate member 30 having a circular outer peripheral edge portion 31 which is received between a pair of annular support members 32 and 33 supported within an upper portion of the housing 27. The support members 32 and 33 embrace the peripheral edge portion 31 of the plate member 30 but allow rotation of the plate 30 together with the mast structure 19 about the vertical axis of the mast structure 19.

The lower end of the tubular member 24 is surrounded by a lower guide member 35 having a mating square cross-section and for which the internal dimensions are slightly greater than the external dimensions of the tubular member 24 to confine the member 24 against lateral movement but allow axial movements thereof within the lower guide member 35. The lower guide member 35 includes an encircling plate member 36 having a circular outer peripheral edge portion 37 which is received between a pair of annular support members 38 and 39 supported by the lower portion of the housing 27. The support members 38 and 39 embrace the peripheral edge portion 37 of the plate member 36 but allow rotation of the plate member 36 together with the mast structure 19 about the vertical axis of the mast structure.

A pair of hydraulic ram arrangements 40 are supported from the upper plate member 30 by means of connecting members 41 attached to the plate member 30 to extend downwardly to a position between a pair of lugs 42 on the upper end of the cylinder 43 for the arrangements 40 with connection being facilitated by pins 44. The piston rods 45 for the arrangements 40 extend downwardly through the lower ends of the cylinders 43 and through aligned holes 46 in the lower plate member 36 to pin attachments 47 at diametrically opposite feet members 25 for the ground engaging support structure 23.

Reverting to FIG. 1, it will be appreciated that when the hydraulic ram arrangements 40 are extended the ground engaging support structure 23 will initially move directly downwardly to seat on the ground or floor beneath the transporter with the mast structure 19 including the tubular member 24 moving downwardly therewith within the upper and lower guide members 29 and 35. Subsequent further extension of the hydraulic ram arrangements 40 will lift the whole lower section 11 of the transporter, including the ground engaging wheels 13 and 14, off the ground to leave the transporter supported solely on the ground engaging support structure 23 as shown in phantom lines in FIG. 1. Reverse movements will occur upon reversal of the action of the hydraulic ram arrangements 40.

An arrangement is provided to allow relative rotation about a vertical axis of the lower section 11 about the stationary mast structure 19 whilst the transporter is supported solely on the ground engaging support structure 23, and for rotating the mast structure 19 and ground engaging support structure 23 as one, within the lower section 11 when the transporter is supported directly on the ground engaging wheels. The rotating arrangement includes the hydraulic motor 21, to the output shaft 48 of which a drive sprocket 49 is attached, drivingly connected by a chain (not shown) to a main sprocket member 50 surrounding the lower end of the tubular member 24 and forming part of the lower guide member 35. Holes 51 are provided through the main sprocket member 50 to allow the piston rods 45 to pass therethrough.

With the ground engaging support structure 23 and the mast structure 19 connected thereto in the upper retracted position, with the transporter being supported by the ground engaging wheels, actuation of the hydraulic motor 21, and therefore the sprocket and chain device, will cause rotation of the whole of the inner assembly of mast structure 19, ground engaging support structure 23, upper and lower guide members 29 and 35, plate members 30 and 36 and hydraulic ram arrangements 40, within the upper and lower support arrangements 32, 33 and 38, 39 and therefore within the lower section 11 of the transporter to thereby rotate the upper table support frame 22 and any table or other load supported thereon around to any required orientation.

If the hydraulic motor 21 is actuated with the ground engaging support structure 23 and therefore the mast structure 19 in the lowered position with the transporter supported solely on the ground engaging support structure 23 with the wheels 13 and 14 of the lower section 11 off the ground, the inner assembly of mast structure 19, ground engaging support structure 23, upper and lower guide members 29 and 35, plate members 30 and 36, hydraulic rams 40 and therefore main sprocket member 50, are prevented from rotating, and as a result the reaction through the chain drive is such as to cause the drive sprocket 49 and therefore the housing 27, and effectively the whole lower section 11, to rotate about the inner assembly, thus achieving rotation of the transporter to a new direction without altering the orientation of the mast structure 19, the upper support frame 22 and any table or other load supported thereon.

It will be apparent that when required the orientation of the table or other load may be altered with respect to the structure surrounding the transporter, or the lower mobile section of the transporter may be rotated to a new direction for motion whilst not altering the orientation of the table or other load with respect to the ground or other supporting surface.

Referring again to FIG. 2 of the drawings, the mast structure 19 further includes a telescopic arrangement to facilitate adjustment of the vertical height of the upper frame 22 above ground level, for example for allowing engagement beneath a casting table at a casting position, subsequent lowering for disengagement from beneath a cast floor slab, and after moving the transporter to another position, elevation to the new casting position at similar level to the previous level, or to a higher level, via an opening through or adjacent to the previously cast floor slab for repositioning there.

The telescopic arrangement includes three coaxial tubular members 51, 52 and 53 of square cross-section received one within the other, and the whole arrangement being received within the tubular member 24. Extending upwardly within the innermost tubular member 51 of the arrangement, and supported adjacent the bottom of the mast structure 19, is a hydraulic ram 54 having a cylinder section 55 and a piston rod or ram member 56. The upper end of the rod or ram member 56 carries a freely rotatable pulley or sprocket wheel 57 over which a rope or chain 58 is received with one end thereof connected to the lower end of the mast structure 19 and the other end to the lower edge of the inner tubular member 51 at an attachment 59.

It will be apparent that upon upward extension of the hydraulic ram 54 the inner tubular member 51 will be elevated within the intermediate tubular member 52 until a stop (not shown) on the outer surface of the lower end of the inner tubular member 51 meets a cooperating stop (not shown) on the inner surface of the upper end of the intermediate tubular member 52, and continued extension of the ram 54 causes the intermediate member 52 to also be elevated. Tubular member 53 remains fixed, being integral at its bottom with the base of the ram.

It will be appreciated that the utilisation of a pulley and rope or sprocket and chain arrangement cooperating with the hydraulic ram effectively magnifies the overall height of the telescopic assembly in relation to the effective ram stroke, and is approximately twice the effective ram stroke to cause elevation of the upper frame 22 to a position 22' as shown in phantom lines in FIG. 1.

Referring to FIG. 3 of the drawings there are illustrated three adjacent working levels in a multi-storied building construction, including a lower level 60 representing a completed floor slab, an intermediate level 61 representing a nearly completed floor slab incorporating an opening 62 therethrough through which slab cast tables are being elevated, and an upper level 63 for which slab casting tables are to be positioned for eventual casting of a floor slab.

A temporary support frame 64 is situated on the lower level 60 immediately beneath the opening 62 through the intermediate level 61, and as shown has a slab casting table 65 supported thereon. A second temporary support frame 66 is situated on the intermediate level 61 to one side of the opening 62. Each of the temporary support frames 64 and 66 include four vertical upright corner members 68 and horizontal connecting members 69. The vertical upright members 68 of each of the temporary support frames 64 and 66 include adjustable jacks 67 at their lower ends to enable adjustment of the vertical height of the frames. A portal frame 70 is provided consisting of a pair of inverted U-shaped members 71 with the upper central portions of each member 71 being interconnected by monorail 72 on which an electric, pneumatic or other suitable hoist (not shown) is supported for movement therealong. The height of the portal frame 70 is such that the monorail 72 is situated above the upper level 63 to be cast, whilst the lower ends of the members 71 are attached by means (not shown) within the opening 62 through level 61. The portal frame 70 may further incude rails 73 attached thereto about the lower ends of the members 71 to effectively form a safety barrier around the opening 62.

Although the arrangement shown in FIG. 3 may be utilised in a variety of ways for shifting slab casting tables from beneath intermediate levels 61 up through the openings 62 for repositioning it up a level 63, in one example, a transporter of the type described in this application collects slab casting tables from their casting positions beneath level 61 and places each in turn on the temporary support frame 64 situated on the lower level 60. The electric hoist supported on the monorail 72 is connected to the table 65 on the support frame 64 and lifts it therefrom up through the opening 62 to adjacent the top of the portal frame 70. The electric hoist is then moved along the monorail 72 to one side of the opening 62 and above the temporary support frame 66 onto which the table is then lowered for collection and repositioning for casting at level 63 by a transporter on the intermediate level 61. Alternatively the table may be lowered directly onto a transporter unit, or in some situations may carry the table directly to the position required for casting at level 63.

After all tables have been transferred from beneath level 61 and positioned for casting at level 63, the transporter resting on the lower level 60 may be hoisted up through the opening 62 by the electric hoist and the opening may be closed by a temporary covering. One, or both, transporters now resting on level 61 may then be moved onto the temporary covering for the opening 62 and the mast or masts raised to engage beneath the upper section of the portal frame 70, after which the lower connections between the portal frames 70 and the edge of opening 62 are disconnected and the portal frame 70 is then elevated by the, or the pair of, transporters for repositioning relative to the upper level 63. Alternatively, an on-site overhead crane may be used to lift the portal frame 70.

After casting of the floor slab at level 63, one of the transporter units on the intermediate level 61 is hoisted by the electric hoist up through an opening left in level 63 to a position resting on level 63 to take its part in the subsequent disengagement and transfer of slab casting tables from beneath level 63 up through the opening in the level 63 for repositioning at the next upper casting level not shown.

Referring to FIG. 4 of the drawings there is shown three levels of a building under construction and in which a transporter of the type previously described with reference to FIGS. 1 and 2 of the drawings is utilised for the purposes of collecting, transporting and repositioning slab casting tables throughout a particular level of the building.

Three building levels are shown in FIG. 4, namely, lower floor slab level 74, and intermediate floor slab level 75 and an upper floor slab level 76 which is in the process of being cast and through all of which levels column 77 pass. In this embodiment the levels are constructed to provide relatively high floor spaces of about 15 feet as may be utilised in a large shopping complex as distinct from conventional office space where the floor heights in the order of 10 to 12 feet would be utilised. With such floor heights involved it will be apparent that the full lifting height capacity of the transporter is being utilised.

As shown, the equipment to construct the upper floor slab level 76 is supported on the previously completed intermediate floor slab level 75. In such circumstances, while the floor slab at the intermediate level 75 is continuing to cure, and to assist sustaining construction loads, particularly in view of the added loading which will be applied to the slab by the temporary props, slab casting tables and the concrete weight imposed thereon during pouring of the upper floor slab level 76 as well as the weight of one or more transporters which will be moving around on the intermediate level 75 collecting, transporting and repositioning slab casting tables, it is preferable to provide a system of back-propping, as shown. Back-propping is standard and known practice in the construction industry.

Thus, as shown, the back-propping comprises group 78 of frame members which include vertical props 79 and interconnecting horizontal members and struts 80. The lower ends of the vertical prop 79 rest on the lowermost floor slab level 74, whilst their upper ends carry bearer engaging members 81 which are connected to the respective props 79 via threaded attachments 82 to allow adjustment of the height thereof during assembly of the groups 78, and as shown the bearer engaging members engage beneath timber bearers 83 which in turn engage underneath the floor slab level 75.

In the particular building construction illustrated, the edge of each of the building levels incorporates a thickened edge-beam 84 poured at the same time and therefore integral with the respective floor slab, and conventional support props 85 are provided for propping these thickened edge-beam sections of the intermediate floor slab level 75, which props include an upper prop member 86 telescopingly received within a tubular lower prop member 87, and incorporate lockable adjustment means 88 to allow adjustment of the height of the prop 85 and to lock it in the supporting position.

A safety hand rail 89 at the edge of each floor slab level is provided for worker safety.

As further shown, the upper floor slab level 76 has been cast upon a number of slab casting tables 90, whilst the thickened edge-beam 84 is formed by a mould cavity defined by side formwork panels 91 and 92 and a lower panel 93 which also extends horizontally to form a working platform, all supported by spaced beams 94 and provided with a hand rail 95. The edge-beam form and working platform structure is supported by prop arrangements 103 which are similar to the props 85 on the level below, but inverted. Each slab casting table 90 is supported from beneath on the intermediate floor slab level 75 by a table support structure comprising inverted props 96 similar to the inverted props 103, but adjusted to the required greater heights, with interconnecting horizontal and diagonal bracing members 97. The upper ends of the inverted vertical telescopic props 96 are attached beneath structural beams 98 which form part of the stiffening structure of the slab casting tables 90.

The inverted telescopic props 96 comprise upper hollow pipes 99 within which lower members 100 are axailly slidably received to allow adjustment of the height of the vertical telescopic arrangements, and thus the position of the slab table 90 supported on the upper ends thereof, and the arrangement of members 99 and 100 incorporate lockable adjustment means 101.

As shown, a transporter 10 of the type previously described with reference to FIGS. 1 and 2 of the drawings is positioned beneath one of the slab tables 90, and the telescopic mast 19 thereof is raised to a position whereby the table support frame 22 engages beneath the table 90 via timber bearers 102. After the support for the table has been taken by the transporter, the lockable adjustment means 101 are released and the lower members 100 of the vertical telescopic arrangements 96 are slid axially up within the upper hollow pipes 99, and the lockable adjustment means 101 are re-engaged to hold the members 100 in the new fixed position relative to the pipes 99. The mast section 19 of the transporter may then be lowered carrying the table 90, and thereafter the transporter may transport the table around on level 75 to a new position making whatever manoeuvers are necessary within the confines of the table support structures for the other tables, making use of the features of the transporter which allow for such manoeuverability as previously described. When the table is to be relocated in an alternative casting position, the mast structure 19 of the transporter elevates the table to the required casting position, the lockable adjustment means 101 are released, the lower members 96 are extended downwardly to floor level 75 whereafter the lockable adjustment means 101 are re-engaged and the mast of the transporter can be lowered from beneath the table.

Referring to FIGS. 5 to 9 of the drawings there is shown part of a transporter 10' representing a modified form of the transporter 10 described with reference to FIGS. 1 and 2, in which modified transporter all the basic features of the transporter of FIGS. 1 and 2 are the same with the exception of the addition of a horizontally slidable carriage arrangement 104 and associated equipment mounted on top of the mast 19'. In this modified form of the transporter the equivalent structure 22' of the upper table support structure 22 which is fixed to the mast 19' does not directly support a table but is adapted to cooperate with a horizontally slidable carriage structure 105 adapted to move lengthwise of the structure 22' between an extended position as shown schematically in FIG. 8 and a retracted position as shown schematically in FIG. 9.

As will be apparent from the following description the carriage arrangement 104 also incorporates a counterweight structure 106 adapted to cooperate with a structure 22' and the carriage structure 105 so as to be movable lengthwise of the structure 22' between an extended position as shown in FIG. 8 and a retracted position as shown in FIG. 9, but in the opposite direction and in unison with the carriage structure 105. The effective weight of the counterweight structure 106 is such as to substantially balance the effect of the weight of a table on the carriage structure 105, particularly in the extended positions thereof, to as much as possible stabilise the transporter during extension of the carriage structure 105, with a slab casting table thereon.

The structure 22' which is equivalent to the table support structure 22 of the embodiment of FIGS. 1 and 2, incorporates longitudinally extending side members 107 in the form of I-beams which are attached at their central portions to the lateral support member 26' on the top of the mast 19' and at one end the side members 107 are interconnected by lateral member 108. A reversible hydraulic ram arrangement 109 is provided, the cylinder 110 of which is supported between the top surface of the lateral support member 26' and the lateral structural member 108 as shown in FIG. 6.

The carriage structure 105 comprises longitudinal side members 111 which are of channel section and are received in sliding engagement within the outwardly directed recesses formed by the I-beam members 107 of the structure 22', and which are interconnected at either end by transverse table support members 112. The piston 113 of the hydraulic ram arrangement 109 is connected to one of the transverse table support members 112 as shown such that by feeding hydraulic fluid to the ram via hydraulic hose line 114 the carriage structure 105 will be moved to the extended position as shown in FIG. 6, and schematically in FIG. 8, and by reversing flow and supplying fluid pressure through hydraulic hose line 115 the carriage structure 105 will be drawn back to a retracted position as shown schematically in FIG. 9.

The counterweight structure 106 is supported to slide longitudinally inwardly and outwardly of one end of the structure 22', and comprises longitudinal side members 116 which slide within the inwardly directed recesses formed by the I-beam members 107 of the structure 22' and which are interconnected at one end by a transverse member 117 which carries a counterweight block 118 with a further transverse member 119 being provided towards the other end of the members 116.

With reference to FIGS. 5 and 6, and more particularly FIGS. 8 and 9, the carriage structure 105 and the counterweight structure 106 are interconnected to allow extension and retraction of the counterweight structure 106 in unison with the carriage structure 105 by two sets of pairs of cables 120 and 121, one set on either side of the carriage arrangement 104.

Each cable 120 is connected to the innermost table support member 112 at 122, and extends around a freely rotatable pulley 123 mounted on the end of the structure 22' from which the carriage structure 105 extends, and the cable then extends along the carriage to an attachment point 124 on the innermost end of the counterweight structure 106. Each cable 121 is connected to a point 125 adjacent the innermost end of the counterweight structure 106, and extends around a freely rotatable pulley 126 mounted on the end of the structure 22' adjacent the counterweight structure 126, and the cable then extends to an attachment point 127 on the same innermost table support member 112 as the attachment 122 for the cable 120.

It will be apparent that upon movement of the carriage structure 105 to the extended position under the action of the hydraulic ram arrangement 109, the cable 121 will draw the counterweight arrangement 106 to a correspondingly extended position, whilst with reversal of the action of the hydraulic ram arrangement 109 the counterweight arrangement 106 will be correspondingly retracted by the cable 120.

As it is the primary requirement of the transporter that there be relative vertical and rotational movement as required between the mast 19' and the lower section of the transporter, the hydraulic lines 114 and 115 for the hydraulic ram arrangement 109 are passed around a spring loaded reel 128 divided axially into two portions, or a combination of separate reels, mounted on the lateral support member 26', whilst the ends of the lines at the point where they enter the lower section of the transporter to communicate with the hydraulic feed system are fixed at 129 to the lower section of the transporter, and the spring loading of the reel 128 is such as to maintain the sections of the lines 114 and 115 between the reel and the lower section of the transporter in tension, to prevent undesirable slack and tangling and other interference with the lines during the vertical or rotational movement of the mast relative to the lower section of the transporter.

Referring to FIGS. 10 and 11 of the drawings there is illustrated two stages in the transfer of slab casting tables from beneath a completed lower level up to the next level for repositioning during the construction of a multi-storied building.

In FIGS. 10 and 11 there is shown a lower floor slab level 130, a just completed intermediate floor slab level 131 and a floor slab level 132 which is to be cast upon repositioning of the slab casting tables being transferred from beneath the intermediate level 131. Vertical columns 133 extend up through the levels as shown. One or more transporters 10' of the type incorporating a horizontally slidable carriage arrangement 104 as previously described and illustrated with reference to FIGS. 5 to 9, are situated on the lowest level 130, and serve to collect slab casting tables 134 from beneath the just completed intermediate level 131 and transport them to the edge of the building to be collected by an overhead crane (not shown), and lifted up to the next level for collection by one or more similar transporters 10' on intermediate level 131, and transported and relocated or repositioned in new casting positions beneath upper level 132 to allow the casting of a floor slab at that level.

The slab casting tables 134 are collected from beneath the just completed floor slab level 131, and in the situation where the slab casting tables have been supported beneath the level 131, slab casting tables may have the facility of resting on the lower flanges of structural I-beams of the structural skeleton of the building.

A slab casting table of this kind is disclosed in a copending Australian Patent Application No. 86909/75, and incorporates retractable support members adapted to extend out beyond the edge of the table and engage on the flanges of the adjacent structural members with jack devices being provided between the tables proper and their adjustable support means. With such a support system for the tables, when it is required to disengage such a table from beneath level 131, the jack devices are actuated to lower the table proper a short distance downwards away from the floor slab to disengage therefrom, whilst the table is still supported on the retractable support members. The transporter 10' is then positioned and the mast 19' elevated to whatever height is necessary to engage beneath the table. The disengaged table is then lifted slightly back up towards the underside of the level 131, the retractable support members are disengaged from the adjacent structural beams, after which the table can be lowered. Thereafter, the transporter 10' transports the table to the edge of the building as shown in FIG. 10 whilst manoeuvering around any corners, columns and other equipment using its manoeuvering capabilities as previously described. At the edge of the building the carriage structure 105 is extended, counter balanced by the counterweight structure 106, to effectively position the centre of gravity of the table outside the line of the edge of the building, where a lifting rig 135 suspended from the overhead crane engages with the table 134, and lifts it up to adjacent the next level as shown in FIG. 11. The lifting rig 135 may be a rig of the type described in a copending Australian Patent Application No. 83343/75, although it may be any type of lifting rig.

A temporary support structure 136 may be situated on the intermediate level 131, and the crane used to move the table 134 into a position whereby it can be deposited on the support structure 136 for subsequent collection, transport and repositioning below level 132 by a transporter 10' situated on level 131. As an alternative, the support structure may be dispensed with on level 131 and the transporter 10' on level 131 moved to a convenient position where the table may be deposited directly onto the transporter by the crane, whereafter the transporter 10' transports and repositions the table.

As an alternative to using slab casting tables having retractable support means for engagement in the casting position with the flanges of structural members such as I-beams, the table could be supported in the casting position by temporary supports or prop arrangements, or alternatively the table may be fixed to its own support structure as described with reference to FIG. 4, and the transporter utilised to cooperate with such arrangements for disengagement, and repositioning, in the manner described with reference to FIG. 4.

FIG. 12 of the drawings shows an alternative system utilising a transporter 10' with carriage arrangement 104 of the type described with reference to FIGS. 5 to 9 of the drawings, for transferring slab casting tables 137 from beneath a completed lower level up to the next level for repositioning during the construction of a multi-storied building.

In FIG. 12 there is shown a lower floor slab level 138, and a just completed upper floor slab level 139 having an access opening 140 therethrough. The slab casting table 137 has already been collected from beneath the just completed floor slab level 139 by the transporter 10' and has been transported to beneath the opening 140, where it has been elevated to above the floor slab level 139, and is in the process of being deposited upon the upper level 139 for subsequent repositioning to cast the next floor slab level above level 139.

In this embodiment the table 137 has a table support structure 141 fixed thereto for transport with the table, which table support structure is of the type described with reference to FIG. 4, and the manner of disengaging the table and support structure 137 and 141 from below a previously cast floor slab section and the manner of repositioning, (in this case by another transporter on the next level) is the same as that described in relation to FIG. 4. In this case the building under construction is such that the distance between successive floors is of commonly encountered height of about 10 feet, and the elevating capacity of the mast 19' of the transporter 10' is such as to cover a total height approaching the equivalent of two floors.

After the transporter 10' has collected a table 137 and its associated support structure 141 from beneath level 139, and has transported it to the access opening 140 and, with the carriage structure 105 in the horizontally retracted position, the mast is operated to elevate the table and support structure through the opening to a position above the level 139. The transporter 10' is then advanced to a position whereby the mast is adjacent one edge of the opening as shown in FIG. 12, and the carriage structure 105 extended thereafter, followed by lowering of the mast sufficiently to deposit the table 137 and support structure 141 onto level 139. The carriage 105 is then retracted, the transporter is realigned with the centre of the opening 140 and the mast is lowered back through the opening, whereafter the transporter proceeds to collect a further table for transfer to the upper level. A transporter (not shown) on the upper level merely collects the deposited table and support structure 137 and 141, and proceeds to transport it to, and reposition it at, the required casting position for the next upper floor slab to be cast.

Although the above description refers to the use of tables carrying their own support structures 141, the system equally well applies to the collection, transfer and repositioning of conventional tables which are merely supported at their slab casting positions by temporary prop arrangements. In such alternative cases the transporter 10' would merely deposit the tables on a support structure situated adjacent the opening 140 for subsequent collection by the transporter on the upper level.

Furthermore in relation to the system described with reference to FIG. 3 which used separate support structures 64 and 66 respectively below and adjacent the opening 62, this system may utilise tables with their own support structure fixed thereto as in the embodiment of FIG. 12, whilst in the embodiment of FIG. 4 which makes use of tables with their own support structures fixed thereto, it is possible to dispense with such support structures and utilise conventional support props to be assembled and disassembled during positioning and disengagement from the casting positions, or tables with retractable support means adapted to rest on the flanges of structural I-beams as discussed previously with reference to FIGS. 10 and 11 of the drawings and as disclosed in a copending Australian Patent Application No. 86909/75.

I claim:

1. A mobile transporter for use in transporting equipment during the construction of a building, said transporter comprising a lower section supported on ground engaging means for movement thereon, a mast supported within said lower section for vertical movement relative to the lower section, and an upper frame supported on the upper end of said mast and adapted, in use, to supportingly engage beneath a load to be transported thereon, wherein the lower end of said mast carries a ground engaging support structure, lifting means interconnected between the support structure and said lower section for, in use, lowering and raising said mast and support structure between a position wherein said lower section is supported on said ground engaging means and a position whereby the support structure is moved to a ground engaging position for subsequently lifting said lower section and its ground engaging means off the ground whereby said lower section is supported on said support structure, and means cooperating with said mast and support structure arrangement and said lower section for achieving relative rotating movement between said lower section and said mast, wherein said mast incorporates means to raise said upper frame independently of said lifting means from a lower position spaced from the ground to a vertically higher position up to in the order of at least twice the distance that the upper frame is above the ground in the lower position, wherein said mast includes a plurality of coaxial telescoping members wherein one of said members is connected to said lower section and another of said members is attached to said upper frame.

2. A mobile transporter according to claim 1, wherein the mast comprises at least two tubular members telescopingly received one within the other, with said upper frame attached to the top of one of said tubular members, and wherein the means for raising the upper frame on said mast is a hydraulic ram adapted to cooperate with said one of said tubular members.

3. A mobile transporter according to claim 2, wherein said mast comprises three of said tubular members, an outer one of which is situated in, and fixed with respect to, said lower section, with the remaining two tubular members providing an inner tubular member to the top of which said upper frame is attached and an intermediate tubular member between said inner and outer tubular members, said inner and intermediate tubular members being coaxial with respect to each other, and said other tubular member, to be coaxially slidable relative to each other, and to said outer tubular member, in telescopic fashion, and wherein said hydraulic ram extends upwardly within said inner tubular member with its upper end carrying a freely rotatable pulley over which an elevating cable passes, one end of which cable is fixed adjacent the lower end of the hydraulic ram and the other end of which is attached to said inner tubular member adjacent the lower end thereof, whereby upon extension of said hydraulic ram said inner tubular member will be raised within said intermediate tubular member in approximately the first half of the effective stroke of the hydraulic ram, said inner tubular member carrying an abutment member adjacent the lower end thereof and said intermediate tubular member carrying a stop member adjacent the top end thereof and in the path of the abutment member on said inner tubular member such that at the end of the first half of the effective stroke of the hydraulic ram said abutment member will come into contact with said stop member whereby over the last half of the effective stroke of the hydraulic ram both the inner and intermediate tubular members will be raised in unison from within said outer tubular member and upon completion of said stroke a portion of the lower end of said intermediate member will remain within said outer tubular member to be supported thereby.

4. A mobile transporter according to claim 1, wherein a tubular support member is provided surrounding said mast within said lower section, and said lower section carries an upper guide member and a lower guide member, said upper and lower guide members being supported in said lower section such as to enable relative rotational movement between said lower section and said guide members about the axis of said mast, said upper and lower guide members engaging respective upper and lower portions of said tubular support member to allow mutual rotation of both the guide and the tubular support member relative to said lower section about the vertical axis of said mast but allowing vertical sliding movement of said support member through said guide members, and wherein said lifting means comprises a pair of hydraulic rams positioned to extend down adjacent opposite sides of said tubular support member with the upper ends thereof being carried by said upper guide member and the lower ends thereof passing through holes through said lower guide member and attached to said ground engaging support structure, whereby upon extension of said hydraulic rams said ground engaging support structure initially moves into said ground engaging position and subsequently lifts the lower section of said transporter off the ground whereby it is supported on said ground engaging support structure via said hydraulic rams.

5. A mobile transporter according to claim 4, wherein the means cooperating with said mast and support structure arrangement and said lower section for achieving said relative rotating movement, comprises a sprocket gear carried by said lower guide member which is coupled via a gear chain to a drive sprocket carried by the output shaft of the motor.

6. A mobile transporter for use in transporting equipment during the construction of a building, said transporter comprising a lower section supported on ground engaging means for movement thereon, a mast supported within said lower section for vertical movement relative to said lower section, and an upper frame supported on the upper end of said mast, wherein the lower end of said mast rigidly carries a ground engaging support structure, lifting means located exterior of said mast and interconnected between the support structure and said lower section and, being free of direct connection to said mast, for, in use, lowering and raising said mast and support structure between a position wherein said lower section is supported on said ground engaging means and a position whereby said support structure is moved to a ground engaging position for subsequently lifting said lower section and its ground engaging means off the ground whereby said lower section is supported on said support structure, means cooperating with said mast and support structure and said lower section for achieving relative rotating movement between said lower section and said mast, and wherein said upper frame carries a horizontally slidable carriage adapted, in use, to supportingly engage beneath a load to be transported thereon, and means are provided to move said carriage between extended and retracted positions relative to said upper frame.

7. A mobile transporter according to claim 6, wherein said upper frame also carries a counterweight structure with means coupling said counterweight structure and said carriage to move said counterweight structure in the opposite direction to, and in unison with, said carriage, to balance the forces imposed by said load when said carriage is in an extended position.

8. A mobile transporter according to claim 6, wherein a tubular support member is provided surrounding said mast within said lower section, and said lower section carries an upper guide member and a lower guide member, said upper and lower guide members being supported within said lower section whereby said guide members and said lower section are rotatable relative to each other about the axis of the mast, said upper and lower guide members engaging respective upper and lower portions of said tubular support member to allow mutual rotation of both the guide means and the support member about the vertical axis of said mast but allowing vertical sliding movement of said support member through said guide members, and wherein said lifting means comprises a pair of hydraulic rams positioned to extend downwardly adjacent opposite sides of said tubular support member with the upper ends of said hydraulic rams being carried by said upper guide members and the lower ends thereof passing through holes through said lower guide member and attached to said ground engaging support structure, whereby upon extension of said hydraulic rams said ground engaging support structure initially moves into said ground engaging position and subsequently lifts the lower section of said transporter off the ground whereby it is supported on said ground engaging support structure via said hydraulic rams.

9. A mobile transporter according to claim 8, wherein the means cooperating with said mast and support structure arrangement and said lower section for allowing said relative rotating movement comprises a sprocket gear carried by said lower guide member which is coupled via a sprocket chain to a drive sprocket carried by the output shaft of a motor.

10. A mobile transporter for use in transporting equipment during the construction of a building, said transporter comprising a lower section supported on ground engaging means for movement thereon, a mast supported within said lower section for vertical movement relative to said lower section, and an upper frame supported on the upper end of said mast, wherein the lower end of the mast carries a ground engaging support structure, lifting means interconnected between the support structure and said lower section for, in use, lowering and raising said mast and support structure between a position wherein said lower section is supported on said ground engaging means and a position whereby said support structure is moved to a ground engaging position for subsequently lifting said lower section and its ground engaging means off the ground whereby said lower section is supported on said support structure, means cooperating with said mast and support structure arrangement and said lower section for achieving relative rotating movement between said lower section and said mast, wherein said mast incorporates means to raise said upper frame independently of said lifting means from a lower position spaced from the ground to a vertically higher position up to in the order of at least twice the distance that the upper frame is above the ground in the lower position, wherein said mast includes a plurality of coaxial telescoping members wherein one of said members is connected to said lower section and another of said members is attached to said upper frame, and wherein said upper frame carries a horizontally slidable carriage adapted, in use, to supportingly engage beneath a load to be transported thereon, and means to move said carriage between extended and retracted positions.

11. A mobile transporter according to claim 10, wherein said mast comprises three tubular members, an outer one of which is situated in, and fixed with respect to, said lower section with the remaining two tubular members providing an inner tubular member to the top of which said upper frame is attached and an intermediate tubular member between said inner and outer tubular members, said inner and intermediate tubular members being coaxial with respect to each other, and said outer tubular member, to be coaxially slidable relative to each other, and to said outer tubular member, in telescopic fashion, and wherein a hydraulic ram is provided extending upwardly within said inner tubular member with its upper end carrying a freely rotatable pulley over which an elevating cable passes, one end of which cable is fixed adjacent the lower end of said hydraulic ram and the other end of which is attached to said inner tubular member adjacent the lower end thereof, whereby upon extension of said hydraulic ram said inner tubular member will be raised within said intermediate tubular member in approximately the first half of the effective stroke of the hydraulic ram, said inner tubular member carrying an abutment member adjacent the lower end thereof and said intermediate tubular member carrying a stop member adjacent the top end thereof and in the path of the abutment member on said inner tubular member such that at the end of the first half of the effective stroke of the hydraulic ram the abutment member will contact the said stop member such that over the last half of the effective stroke of the hydraulic ram both the inner and intermediate tubular members will be raised in unison from within said outer tubular member and upon completion of said stroke a portion of the lower end of said intermediate member will remain within said outer tubular member to be supported thereby.

12. A mobile transporter according to claim 10, wherein a tubular support member is provided surrounding said mast within said lower section, and said lower section carries an upper guide member and a lower guide member, said upper and lower guide members being supported within said lower section such as to allow relative rotational movement between said guide members and said lower section about the axis of said mast, said upper and lower guide members engaging respective upper and lower portion of said tubular support member to allow mutual rotation of both the guide members and the tubular support member therewith about the vertical axis of said mast but to allow vertical sliding movement of said support member through said guide members, and wherein said lifting means comprises a pair of hydraulic rams provided to extend down adjacent opposed sides of said tubular support member with the upper ends thereof being carried by said upper guide member and the lower ends thereof passing through holes through said lower guide member and attached to said ground engaging support structure, whereby upon extension of said hydraulic rams said ground engaging support structure initially moves into said ground engaging position and subsequently lifts the lower section of the transporter off the ground whereby it is supported on said ground engaging support structure via said hydraulic rams.

13. A mobile transporter acording to claim 12, wherein the means cooperating with said mast and support structure arrangement and said lower section for allowing for said relative rotating movement comprises a sprocket gear carried by said lower guide member and which is coupled by a sprocket chain to a drive sprocket carried by the output shaft of a motor.

14. A mobile transporter according to claim 10, wherein said upper frame also carries a counterweight structure with means coupling said counterweight structure in the opposite direction to, and in unison with, said carriage, to balance the forces imposed by said load when the carriage is in an extended position.

15. A mobile transporter according to claim 1, wherein said transporter further includes a horizontally slideable carriage carried on said upper frame and adapted, in use, to supportingly engage beneath a load to be transported thereon, and means cooperating with said carriage to move same between extended and retracted positions relative to said upper frame.

* * * * *